US005678483A

United States Patent [19]

Johnson

[11] Patent Number: 5,678,483

[45] Date of Patent: Oct. 21, 1997

[54] METHOD FOR PRINTING A BLACK BORDER FOR A COLOR FILTER

[75] Inventor: Ronald E. Johnson, Tioga, Pa.

[73] Assignee: Corning Incorporated, Corning, N.Y.

[21] Appl. No.: 573,476

[22] Filed: Dec. 15, 1995

Related U.S. Application Data

[63] Continuation-in-part of Ser. No. 499,982, Jul. 10, 1995, Pat. No. 5,624,775, and a continuation-in-part of Ser. No. 197, 141, Feb. 16, 1994, Pat. No. 5,544,582.

[51] Int. Cl.[6] ..... B41M 1/04; B41M 1/10; B41M 1/24; B41M 1/34

[52] U.S. Cl. ..... 101/153; 101/35; 101/483; 156/240; 427/266

[58] Field of Search ..... 101/35–37, 41, 101/44, 129, 150, 153, 163, 170, 211, 424.1, 483, 491; 430/7; 156/235, 240, 277; 427/162, 165, 266, 269, 277, 278, 287, 511

[56] References Cited

U.S. PATENT DOCUMENTS

| | | | |
|---|---|---|---|
| 4,035,214 | 7/1977 | Shuppert et al. | 156/240 |
| 4,549,928 | 10/1985 | Blanding et al. | 156/660 |
| 5,127,330 | 7/1992 | Okazaki et al. | 101/450 |
| 5,514,503 | 5/1996 | Evans et al. | 430/7 |
| 5,533,447 | 7/1996 | Johnson et al. | 101/211 |
| 5,535,673 | 7/1996 | Bocko et al. | 101/211 |
| 5,540,147 | 7/1996 | Johnson | 101/211 |
| 5,544,582 | 8/1996 | Bocko et al. | 101/211 |

FOREIGN PATENT DOCUMENTS

| | | | |
|---|---|---|---|
| 61-284441 A | 12/1986 | Japan | 101/424.1 |
| 5-147359 | 12/1993 | Japan . | |

OTHER PUBLICATIONS

Katsuhiko Mizuno and Satoshi Okazaki, "Printing Color Filter for Active Matrix Liquid–Crystal Display Color Filter", Nov. 1991, Japanese Journal of Applied Physics, vol. 30 No. 118, pp. 3313–3317.

*Primary Examiner*—Stephen R. Funk
*Attorney, Agent, or Firm*—Robert L. Carlson

[57] ABSTRACT

A method and apparatus for making color filters for liquid crystal display panels. A transfer layer is formed on a collector roll, and a raised pattern corresponding to the desired black matrix pattern is formed on the transfer layer by embossing. A plurality of colored ink patterns is formed in the appropriate location within the boundaries formed by the raised pattern, thereby forming the multicolor image that will become the color filter. This multicolored image is then transferred to the substrate. Preferably, the inks are deposited into the black matrix pattern using typographic imaging pins which are smaller than the cells of the black matrix pattern.

22 Claims, 7 Drawing Sheets

METHOD FOR PRINTING A BLACK BORDER FOR A COLOR FILTER

RELATED APPLICATIONS

This application is a continuation-in-part of Ser. No. 08/499,982 filed Jul. 10, 1995, now U.S. Pat. No. 5,624,775, and a continuation-in-part of Ser. No. 08/197,141 filed Feb. 16, 1994, now U.S. Pat. No. 5,544,582.

FIELD OF THE INVENTION

The invention relates to color filters for liquid crystal display panels and methods for their production.

BACKGROUND OF THE INVENTION

Liquid crystal display panels (LCDS), particularly color LCD panels, are used for flat screen televisions, projection television systems and camcorder view finders, with many more applications anticipated in the future.

The fabrication of an active matrix liquid crystal display involves several steps, one of which involves formation of a color filter element onto a suitable substrate, such as glass. Color filters typically are comprised of a black matrix pattern and three primary (typically either red, green and blue or yellow, magenta and cyan) color patterns located within the spaces outlined by the black matrix pattern. The printed lines which form the black matrix typically are about 15–25 microns wide and about 0.5 to 2 microns thick. The red, green, and blue color cells are typically on the order of about 70–100 microns in width by 200 to 300 microns in length. Consequently, most manufacturers of color filters are doing so by photolithographic techniques. While a few color filter manufacturers are using printing techniques to form the color pixels, most of them are still using photolithography to form the black matrix. If printed, the color cells are typically printed in films less than about 10 microns thick, and preferably less than 5 microns thick, and must be evenly applied and accurately registered within the pattern formed by the black matrix. The front glass substrate is typically completed by depositing a planarizing layer, a transparent conducting layer, and a polyimide alignment layer over the color filter element. The transparent conducting layer is typically indium tin oxide (ITO), although other materials can also be utilized.

A black border, typically about 1–5 mm wide, is also provided around the perimeter of the black matrix and color filter. The black border has similar requirements to the black matrix in terms of optical density and reflectivity. It is also desirable that it have a uniformly smooth surface and thickness. The thickness of the black border should preferably be equal to or less than the colored pixel portion of the color filter. Generally the same process used to make the black matrix is used to make the black border area. Consequently, the black border is usually sputtered chrome or chrome-chrome oxide; or, a black photo-resist. In either case photolithography is utilized to image the border as well as the black matrix. Printing techniques for forming the black border are possible, but are generally not used because of surface uniformity, and pin-hole (light leakage) issues, as well as the desire not to complex the overall process of color filter production by using a different process for the border than is used for the black matrix.

However, there is still a desire for ink printing methods for making black border areas.

SUMMARY OF THE INVENTION

The present invention relates to an improved method of forming border areas for flat panel display color filters, such as the black border area which typically surrounds the color filter in a liquid crystal display. In the present invention, a raised pattern is formed, and the ink that makes up the black border of the color filter is then deposited within the recesses formed by the raised pattern. Preferably, the raised pattern is formed using mechanical forming techniques. However, the invention could also be employed on raised patterns formed using other techniques (e.g. photolithography) as well.

In one embodiment, the border ink is deposited within the recesses of the raised pattern utilizing typographic ink imaging pins, which preferably are smaller than the spaces formed by the raised pattern, to facilitate deposition of the ink within the black matrix pattern without smearing the ink on the black matrix or mixing of the different ink colors. Alternatively, other ink applicating methods, such as ink jet or bubble jet, could be employed to deposit the border ink within the recesses.

DETAILED DESCRIPTION OF THE INVENTION

In the present invention, a raised pattern is formed, and ink is deposited within the recesses formed by the raised pattern to form a border for a color filter pattern. Preferably, the raised pattern is formed using mechanical forming techniques. By mechanical forming techniques, it is meant that the raised pattern is formed mechanically, such as by mechanical embossing or intaglio printing techniques, as opposed to photolithographic and other chemical forming techniques, wherein a portion of material is removed chemically after formation. However, the invention is not limited to use with raised patterns that have been mechanically formed, and other techniques, including photolithography, could be utilized to make the raised patterns.

Figure 1:
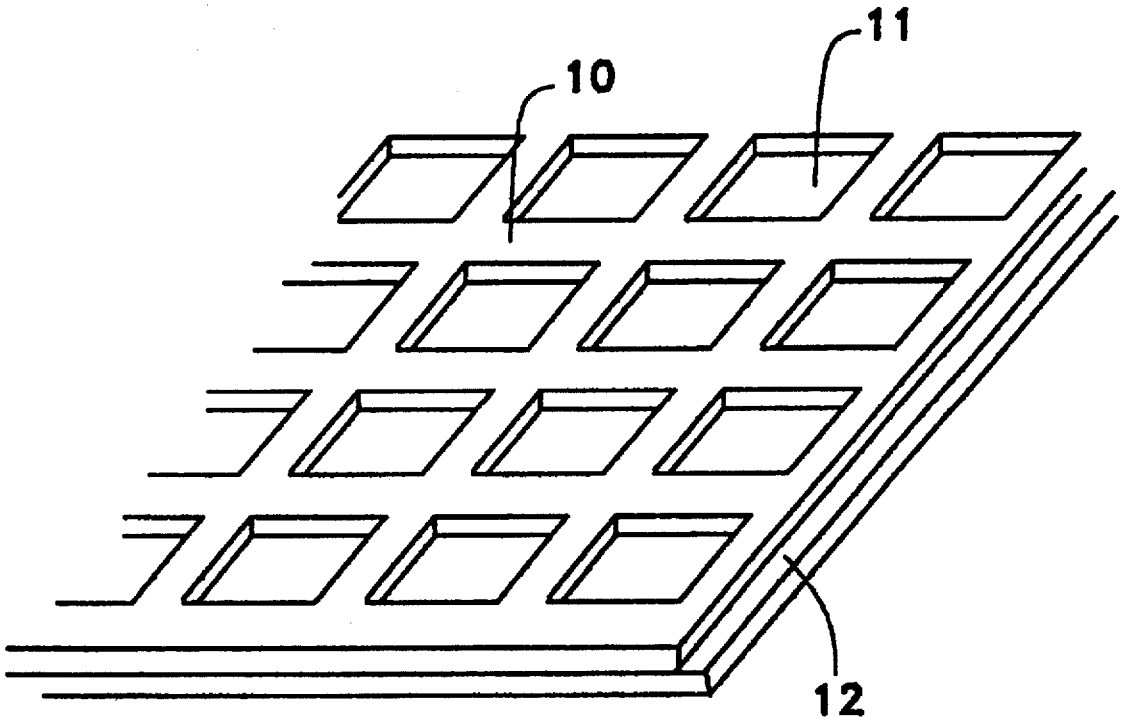
FIG. 1 illustrates a perspective view of a raised pattern in accordance with the present invention.
Figure 2A:
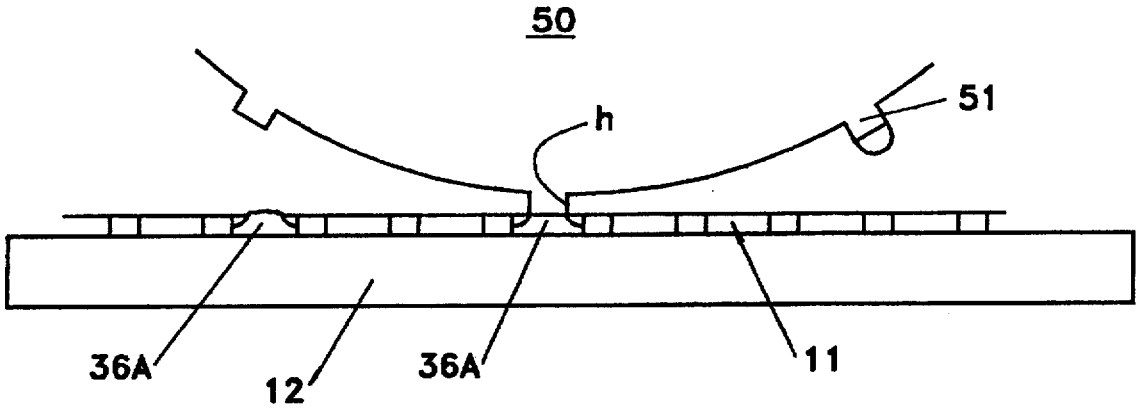
FIG. 2A illustrates the deposition of an ink into the recess of a raised pattern from an imaging roll in accordance with the invention.
Figure 2B:
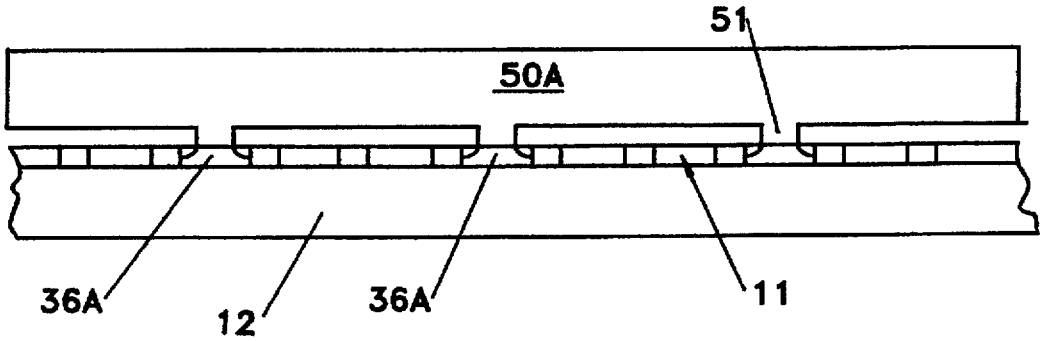
FIG. 2B illustrates the deposition of an ink into the recess of a raised pattern from an imaging plate in accordance with the invention.

In the present invention, a raised pattern 10, such as, for example, the one illustrated in FIG. 1, is formed on a suitable substrate 12. Then, in areas where a black border is desired, black border ink is deposited within the recesses 11 formed by raised pattern 10, as illustrated in FIGS. 2A and 2B. Preferably, the black border ink is deposited using typographic ink imaging pins. Such typographic ink imaging pins can be supplied, for example, on a pattern roll 50, as illustrated in FIG. 2A, or on a pattern plate 50A, as illustrated in FIG. 2B. In FIGS. 2A and 2B, pattern roll 50 and pattern plate 50A, respectively, comprise a plurality of typographic ink imaging pins 51. The imaging pins 51 carry the black border ink 36A and deposit the ink within the recesses 11 formed by black matrix pattern 10. Alternatively, the typographic imaging pins could be replaced by ink jet or bubble jet heads, which would then inject the ink into the recesses. Alternatively, the ink could be deposited into the recesses using lithographic printing methods.

In another embodiment, the imaging pins are porous imaging pins, and the ink is forced through the porous imaging pins. The imaging plate or roll could, for example, comprise a reservoir for containing the pixel ink behind the porous imaging plate, and the pixel ink selectively forced through the porous imaging pins of the imaging plate to apply ink to the printing surface of the imaging pins. Such porous imaging pins are discussed further in U.S. patent application Ser. No. 08/491,425, filed Jun. 16, 1995, titled METHOD AND APPARATUS FOR MANUFACTURING COLOR FILTERS FOR FLAT PANEL DISPLAYS, the specification of which is hereby incorporated by reference.

In a preferred embodiment, the raised pattern corresponds to a desired black matrix pattern. Such a black matrix pattern could be mechanically formed, such as by the ink printing methods discussed herein, or alternatively, the black matrix pattern could be formed by photolithography. Either way, the same geometric pattern used for the black matrix pattern is preferably extended into the areas of the desired black border. However, if desired, a raised pattern geometry which is different than the black matrix pattern could be provided in the areas of the black border.

Figure 3:
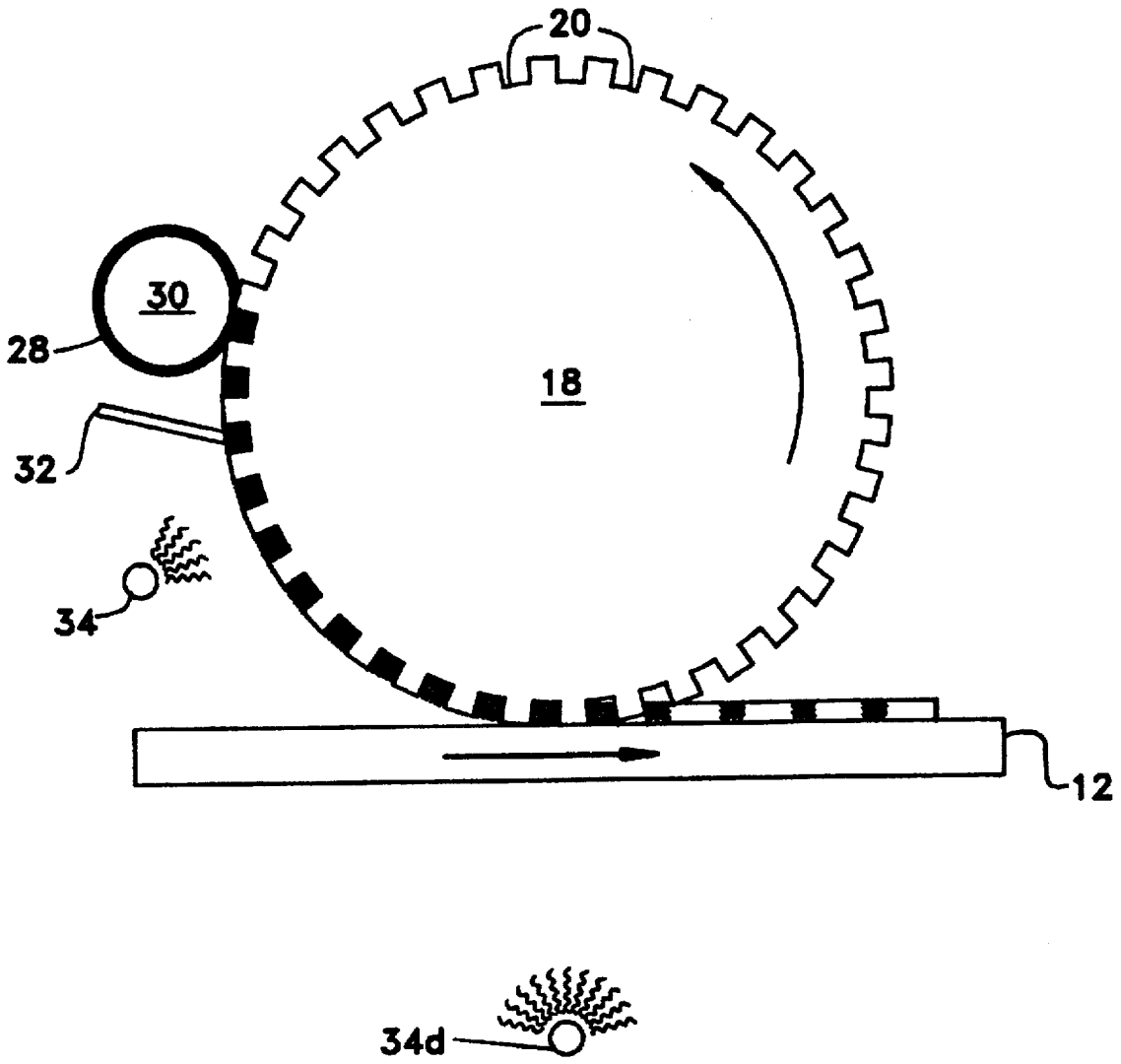
FIG. 3 illustrates an apparatus for printing a raised black matrix pattern onto a glass substrate.

As illustrated in FIG. 3, the matrix for containing the border ink can be produced by printing a raised pattern onto a suitable substrate. In FIG. 3, black matrix ink 28 is deposited into recessed pattern 20 of intaglio black matrix imaging roller 18, then cured or hardened within recessed pattern 20, so that the shape of recessed pattern 20 is retained by the ink. The ink is then transferred to the glass substrate 12. In one embodiment, an adhesive layer is deposited on the glass substrate prior to receiving the black border matrix pattern. Suitable adhesives include the materials described herein for transfer layer materials, or the unpigmented mediums (vehicles) employed in formulating sub-pixel inks. Preferably, the ink 28 is cured simultaneous with transfer to the glass 12 (e.g., by UV light 34*d*). The adhesive layer is preferably liquid prior to contacting the black matrix pattern, and preferably is also cured or hardened during or soon after (most preferably during) transfer of the black matrix pattern to the glass substrate 12. Such curing may be accomplished by employing ultraviolet radiation curable materials to form the adhesive layer, and applying radiation, via ultraviolet (UV) light 34*d*, for example, to the adhesive layer during deposition of the black matrix pattern 10. The resultant black matrix pattern would be very similar in appearance to the black matrix pattern illustrated in FIG. 1. Printing of the black border ink within the raised pattern 10 can then be accomplished using the methods illustrated in FIGS. 2A and 2B.

Figure 2C:
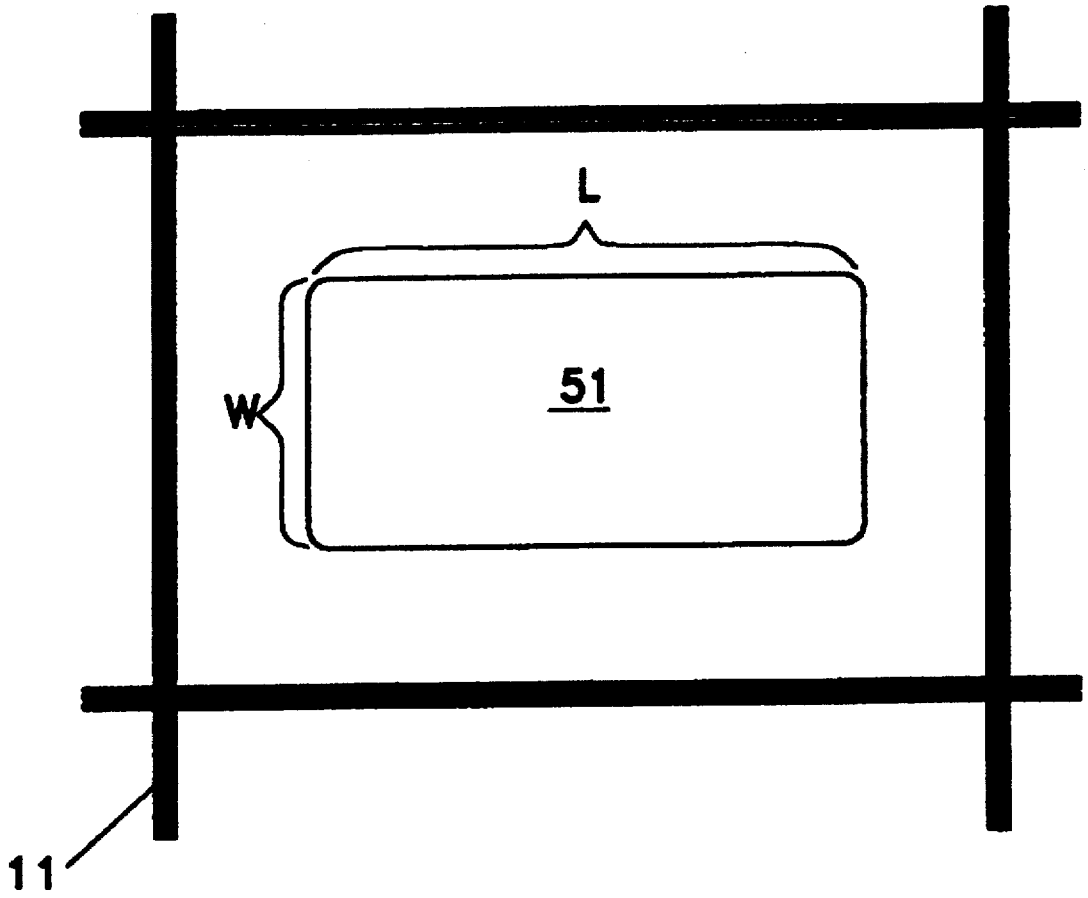
FIG. 2C is an enlarged partial top view of an imaging pin depositing ink into a black matrix pattern from an imaging roll or plate as illustrated in FIGS. 2A and 2B.

FIG. 2C illustrates a top view of the process illustrated in FIG. 2A, showing black matrix pattern 10 and typographic ink imaging pin 51 positioned within a recessed cell 11 formed by black matrix pattern 10 to deposit a color ink 36A therewithin.

Preferably, the ink is deposited into the cells using ink imaging pins which have a smaller size than the cell size formed by the raised pattern. For example, when using typographic imaging pins to deposit the inks within a recessed cell 11 having dimensions of approximately 50 by 175 microns, the ink imaging pin should have a dimension in which the width W is between 20 and 40 microns and the length L is between 140 and 160 microns. More preferably, the ink imaging pin has a width between 25 and 35 microns and a length between 145 and 155 microns. Most preferably, the pin has a width of about 30 microns and a length of about 150 microns. Thus, the width W of the pin is preferably between 10–30 microns smaller than the black matrix cell width, more preferably 15–25 microns smaller than the cell width and most preferably about 20 microns smaller than the cell width, whereas the length L of the pin should be between about 15–25 microns shorter than the cell length, more preferably about 20–30 microns shorter than the cell length, and most preferably about 25 microns shorter than the cell length. The height h of the typographic pin can also be important. For example, in one process which utilizes typographic pins to deposit colored ink within black matrix cells having a dimension of about 50 by 175 microns, the inking thickness on the inking roll should be about 24 microns when using a pin approximately 30 microns wide by 150 microns long. Because it is desirable to have the typographic pin longer in height than the thickness of the ink on the inking roll, the height h (as illustrated in FIGS. 2A and 2B) of the imaging pins in such embodiments should be at least 30 microns, more preferably at least 35 microns, and most preferably about 40 microns in height.

The present invention can also be used to compliment Corning Incorporated's transfer layer process for printing color filters. This transfer layer process is described, for example, in U.S. Pat. No. 5,544,582, the specification of which is hereby incorporated by reference.

In this process, a transfer layer is deposited onto a collector device, such as a collector roll or collector plate. A raised pattern is then formed on the transfer layer. This upraised pattern could be, for example, a raised black matrix pattern, or a raised pattern which corresponds to the desired black matrix pattern. In one embodiment of the present invention, a similar raised pattern is formed in the area corresponding to the desired black border area. The red, green and blue color dot patterns are deposited within the recesses corresponding to the color filter, and the black border ink is deposited within the recesses corresponding to the black border area. The resultant composite, which consists of the transfer layer, a raised pattern (which may or may not be the black matrix pattern) color pixel cells, and black border area, is then transferred in one step to the glass substrate.

The transfer layer provides a unique surface on which to form the black matrix pattern, each of the red, green and blue (or yellow, magenta, and cyan) color dot patterns, and the black border. Forming the color filter pattern on a transfer layer enables the entire assembly, consisting of the transfer layer, black matrix pattern, color pixel patterns, and black border, to be transferred to a substrate so that the color filter is sandwiched between the transfer layer and the substrate. Because the transfer layer acts as an in-situ formed planarizing layer, no subsequent operation is needed to a form a planarizing layer. The present invention can be used to compliment this process because the process used to make the raised black matrix pattern can be extended to the desired border area.

The transfer layer may be formed using, for example, those materials selected from the group consisting of polyimides, epoxides, acrylics, vinyl ethers, polyurethanes, polyesters, and acrylated or methacrylated acrylics, esters, urethane, or epoxides, and other materials which are conventionally useful as planarizing layers in conventional color filter devices. One suitable material for the transfer layer is a radiation curable material, such as an acrylated epoxide. The transfer layer is deposited onto a collector device as a thin film, typically less than 10 microns. Preferably, the transfer layer is formed of a radiation curable material to facilitate curing.

Figure 4:
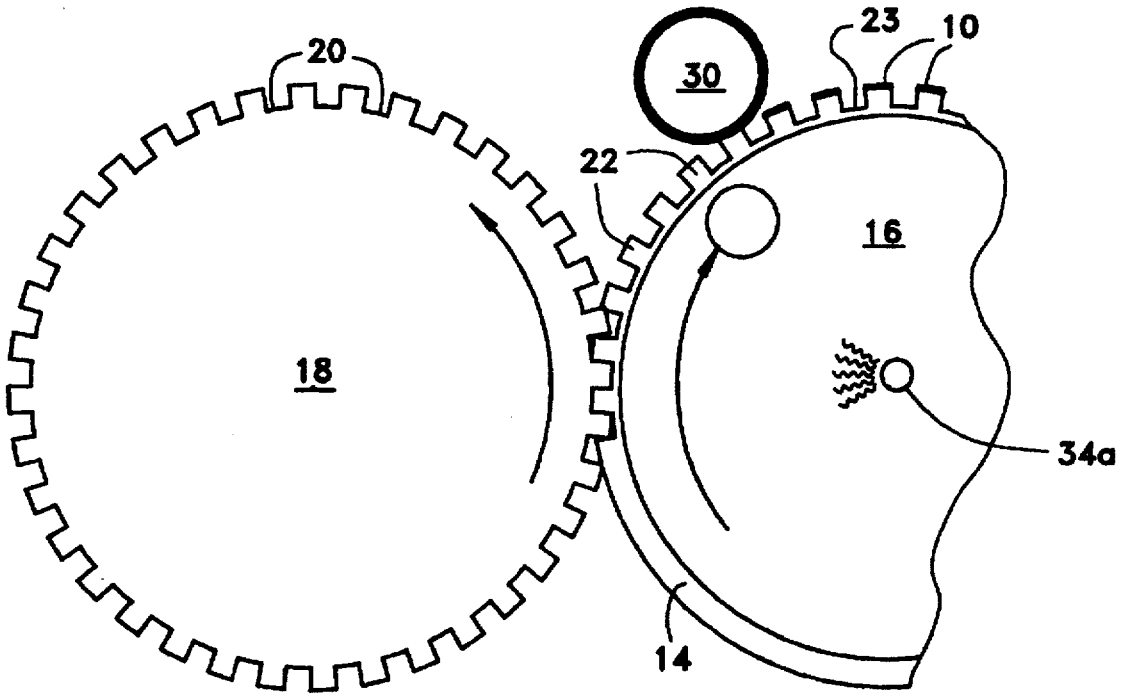
FIG. 4 illustrates an apparatus for forming a raised black matrix pattern in accordance with the present invention.
Figure 5:
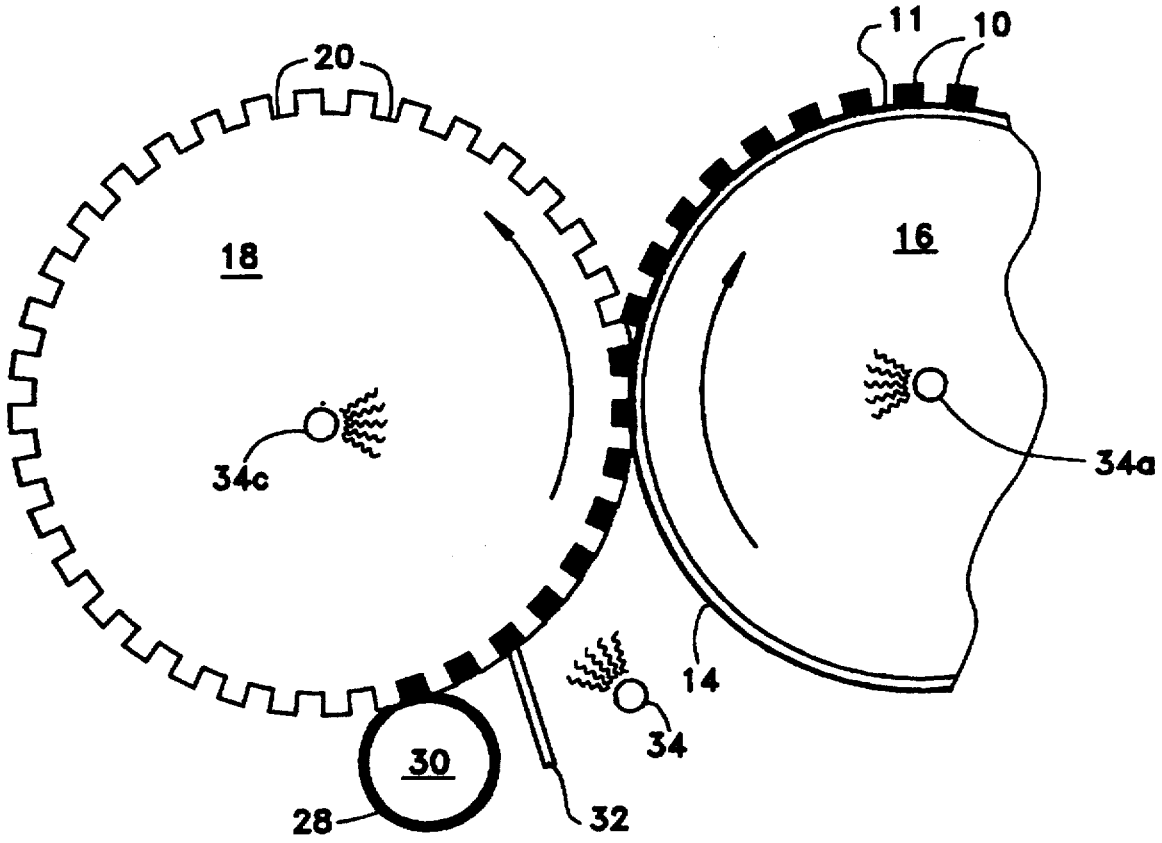
FIG. 5 illustrates an alternative apparatus for forming a raised black matrix pattern in accordance with the present invention.

In FIGS. 4 and 5, a transfer layer 14 is applied to a collector roll, and then a raised pattern is formed on transfer layer 14. Transfer layer 14 may be applied using ink-type applicating rollers or slot coating techniques. The raised pattern can be formed on transfer layer 14 using a variety of techniques. For example, in FIG. 4, transfer layer 14 is contacted by patterned intaglio roller 18 (with no ink thereon) while transfer layer 14 is in a deformable state. In the area corresponding to the red, green, and blue pixels, patterned intaglio roller 18 has a recessed pattern 20 thereon corresponding to the shape of the desired black matrix pattern. This identical raised pattern may be extended into the area corresponding to the border as well. Of course, if desired, a different geometry or size of recessed cell may be used in the black border area. As a result, patterned intaglio roller 18 (which could alternatively be an intaglio plate) contacts the deformable transfer layer 14 and forms raised pattern 22, which corresponds to the desired black matrix pattern 10, and also extends into the desired border area. Transfer layer 14 is then hardened sufficiently to retain the embossed pattern obtained from roll 18. This can be accomplished by utilizing thermoplastic inks and cooling the transfer layer, at the point of contact with roll 18, to set the ink. Alternatively, and more preferably, radiation curable inks are employed, and radiation is emitted from ultraviolet light 34*a* through roll 16 to cure the transfer layer 14 during the embossing operation. Black matrix ink may then be applied to raised pattern 22 to form a raised black matrix pattern 10. In the embodiment illustrated in FIG. 4, black matrix ink 28 is applied from black matrix ink applicator roll 30 to upraised pattern 22 to form raised black matrix pattern 10.

Alternatively, the black matrix ink 28 can be applied at a different location in the process of manufacturing the liquid crystal display panel. For example, the black matrix ink can be applied on the other (TFT) glass substrate. If desired, the black matrix pattern can be deposited on top of the thin film transistor. For applications in which the black matrix pattern is deposited on the TFT substrate, it is felt that formation of the raised pattern 22 on transfer layer 14 is key, in order to separate and align the various red, green, and blue color cells with the black matrix pattern. By then registering the black matrix pattern 10 to align with raised pattern 22, when one looks down at the resultant liquid crystal display, the color cells will appear to be within the black matrix pattern.

The red, green, and blue color ink cells which make up the remainder of the color filter pattern, as well as the black border ink which makes up the black border, are then deposited within the recesses 23 formed by raised pattern 22 on transfer layer 14. This may be accomplished, for example, using typographic ink imaging pins such as those illustrated in FIGS. 2A and 2B. The entire composite, consisting of transfer layer 14, black matrix pattern 10, the red, green, and blue color cells, and the black border, is then transferred, in a single deposition step, to a glass substrate.

FIG. 5 illustrates an alternative embodiment which utilizes the transfer layer concept. In this embodiment, a transfer layer is again transferred onto collector roll 16. The apparatus in FIG. 5 is similar to that illustrated in FIG. 4. However, intaglio roller 18 is now used as a black matrix ink patterning roll. The intaglio roller 18 in FIG. 5 has ink receiving recessed pattern 20 thereon, which receives radiation curable, thermal wax, or solvent based black matrix ink 28. In a preferred embodiment, ink applicating roller 30 applies radiation curable black matrix ink 28 into recessed pattern 20. Excess ink is removed from the pattern by doctor blade 32. The ink is then cured or set within recessed pattern 20, such as, for example, by exposure to ultraviolet radiation from UV lamp 34, thereby forming a black matrix pattern 10 which will at least substantially retain the shape of the recessed pattern 20. Alternatively, intaglio roll 18 is constructed of radiation transparent material, and a UV light 34*c* is mounted therein to cure or partially cure the black matrix ink while it is retained within recessed pattern 20. Such curing or setting of the black matrix ink could alternatively take place simultaneous with contact of the black matrix ink with the transfer layer. For example, the black matrix ink could be cured by radiation from UV light 34*a*. When the curing or hardening of the black matrix ink is accomplished, the black matrix is sufficiently hardened so that the ink retains the shape of recessed pattern 20. Black matrix patterning roller 18 is then contacted with transfer layer 14 to transfer the cured or otherwise hardened black matrix pattern 10 from recessed pattern 20 on patterning roller 18 to transfer layer 14 on collector roll 16. This results in a black matrix pattern 10 deposited on transfer layer 14 which resembles that in FIG. 1. This black matrix pattern can be extended to the area of the black border area. The transfer layer is preferably smooth, and preferably liquid prior to receiving the black matrix ink. It is important that the intaglio imaging surface be more releasing than the collector surface. Ink in intaglio and gravure print plates typically has a negative meniscus, the surface of the ink in the recessed intaglio pattern curving below the print plate surface. Consequently, the transfer layer must be sufficiently soft and tacky to contact and adhere to the black matrix ink and remove the ink from the recesses of the intaglio print pattern. In a preferred embodiment, transfer layer 14 and black matrix pattern 10 are cured simultaneously during transfer of the black matrix pattern 10 to transfer layer 14, e.g., by UV lights 34*a* or 34*c*.

The process illustrated in FIG. 5 can be in place of or in addition to the transfer layer shaping process illustrated in FIG. 4. Thus, if desired, a first roll 18 can be used to form a raised pattern on transfer layer 14, after which a second roll 18 can be used to deposit a cured, raised black matrix pattern on top of the raised pattern 22.

Completion of the color filter involves formation of the color pixels and border. Each color pixel typically consists of a red, green, and blue subpixel (subpixels are also herein referred to as color cells). In all of the above described embodiments, after the raised pattern 10 (or raised black matrix pattern 10) has been applied to transfer layer 14, the red, green and blue color cells of the color filter pattern are applied to transfer layer 14, in the area where the color filter is desired, within the recesses 11 formed by raised pattern 10. In the area of the raised pattern corresponding to the border area, black ink is deposited within the recesses formed by the raised pattern. If ink is used to form the black matrix pattern, the same ink used to make the black matrix (and preferably also the black border matrix) may be used to fill in portions of this black border matrix to form the black border. However, preferably, the black ink for filling in the cells is designed to function in the process like a sub-pixel ink, and is therefore formulated accordingly; i.e., it should preferably have a high affinity for glass adhesion and enable transfer of the rest of the color filter composite to the glass when cured under compression. Preferably, the red, green, blue, and black border color cells are deposited within raised pattern 10 using typographic ink printing techniques, as illustrated in FIGS. 2A or 2B. After deposition of the red, green, blue and black color ink cells within raised pattern 10, the entire composite, which consists of transfer layer 14, raised pattern 10, the red, green and blue color cells 36, and a black border, is transferred to a glass substrate 12.

Figure 6:
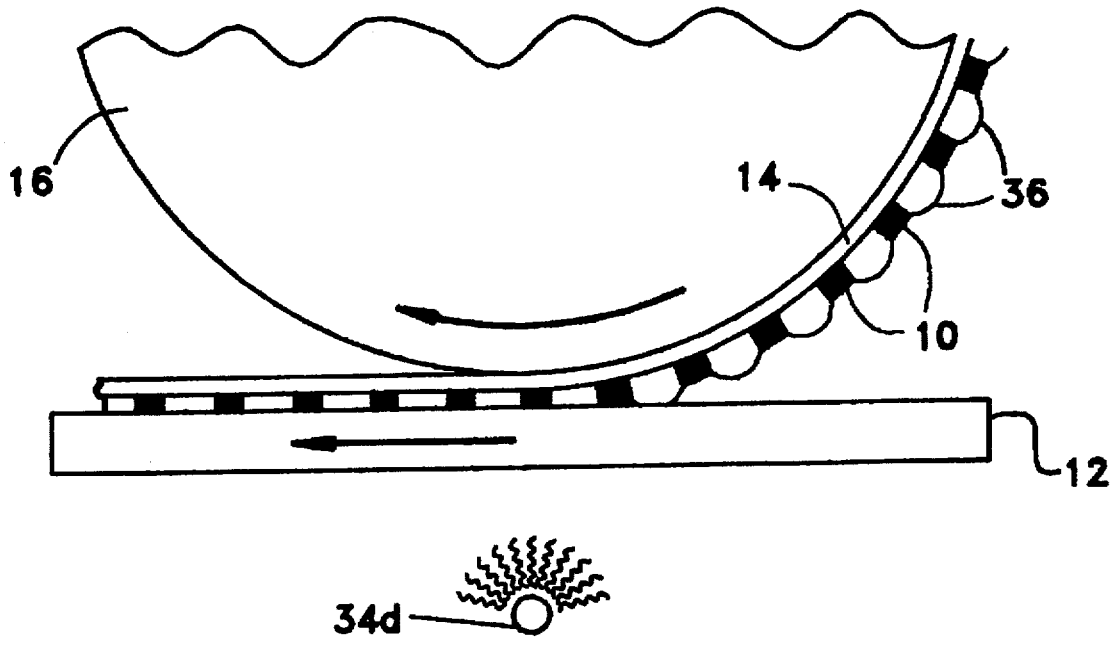
FIG. 6 illustrates the deposition of a color filter pattern and black border, formed in accordance with the invention, to a glass substrate.

FIG. 6 illustrates the deposition of a black matrix pattern 10, black border 36A, color filter pattern, and transfer layer 14 to a glass substrate 12. During deposition of the composite to the substrate, the ink cells 36 which comprise the red, green, blue and black border color cells is preferably in a liquid or otherwise deformable state. Consequently, the ink cells are squeezed, during the deposition, between transfer layer 14 and glass substrate 12, and thereby deformed to a smoother, more uniform ink dot shape and thickness. This more uniform shape and thickness is retained, preferably by curing simultaneous to the transfer operation. Such curing can be accomplished via UV light **34*d*, which is positioned to emit radiation through the glass substrate. Preferably, during the deposition operation, the ink cells deform and completely fill the spaces formed by the grids of the black matrix pattern. Although the raised cell walls restrict the ink flow, in so deforming, the ink cells may still overflow the raised pattern 10** slightly. Such overflow is normally acceptable.

Color filters typically require approximately 15–25 micron width black matrix lines, and small color cells which are typically on the order of about 70–100 microns in width by 160 to 300 microns in length. The color cells are typically printed in films less than about 10 microns thick, and preferably less than 5 microns thick. These thin color cells must be evenly applied and accurately registered within the black matrix patterns. In carrying out the present invention, conventional radiation-curable inks are generally preferred over thermoplastic inks, partly because they can be printed at lower viscosities, which helps in printing such thin cells. Also, it is more difficult to control the pattern registration of hot melt thermoplastic inks, as they require extremely tight thermal tolerances to control pattern dimensions. In addition, radiation curable inks are easily cured during compression transfer operations in accordance with the invention. Thermoplastic inks do have at least one advantage, in that they can be formulated to set up immediately upon deposition to a substrate or transfer roll having a lower temperature, resulting in less pinholes, film non-uniformities and other such defects which can be caused by inadequate wetting of transfer surfaces. Consequently, another preferred type of ink is one that displays both thermoplastic and radiation curable properties. Such an ink is one which is formulated to be thermoplastic until printed to the substrate, at which point it can be cured by exposure to appropriate radiation. By cured, it is meant that the ink is to some extent cross-linked. Cross-linking of the ink increases its durability and resistance to higher temperatures, which is preferable due to the temperatures the color filter will be exposed to in subsequent processing steps. For the black matrix ink, another preferred type of ink is a solvent based formulation in which a volatile solvent is incorporated into the ink to lower the viscosity during inking and doctoring, the solvent being chosen so that it is compatible with the ink and readily evaporated from the thin (preferably 2 to 5 micron) black matrix pattern in the intaglio plate before contact with the transfer layer. The ink may then undergo crosslinking during subsequent radiation or thermal cure.

The inks may undergo final curing, during or after deposition to the substrate, by exposure to either radiation, thermal, moisture or other type of curing process, to achieve a hard, tack-free, durable state.

Although the invention has been described in detail for the purpose of illustration, it is understood that such detail is solely for that purpose and variations can be made therein by those skilled in the art without departing from the spirit and scope of the invention which is defined by the following claims.

For example, in the embodiments illustrated herein, the ink employed for the border has been black. However, the border ink is not limited to this color, and other colors could be employed if desired. In addition, transfer layer 14 is applied to a collector roll 16. However, the present invention is not limited to collector rolls, and thus other types of collector devices, such as plates, could also be utilized. Likewise, wherein some of the embodiments illustrated herein utilize pattern rollers, flat pattern plates could also be employed.

In addition, most of the embodiments described herein disclose depositing the border ink within square or rectangular cells formed by a criss-crossing border matrix area (similar to a black matrix pattern). However, alternatively, the black border matrix could be alternatively shaped, such as, for example, a plurality of alternating raised and recessed rows or stripes, the recesses between the rows being subsequently filled with ink (similar to the embodiments disclosed above) to form the border area.

What is claimed is:

1. A method for making a border for a color filter, comprising:

forming a pattern of recesses on a substrate, said pattern of recesses corresponding to a desired black border area; and depositing a filler ink into said recesses to form said border.

2. The method of claim 1, wherein said depositing filler ink step comprises depositing a black ink within said recesses to form a black border.

3. The method of claim 1, wherein said depositing filler ink step comprises depositing said ink using imaging pins having a smaller width and a smaller length than the width and length of said recesses.

4. The method of claim 1, wherein said depositing filler ink step comprises depositing said ink using a printing technique selected from the group consisting of typographic, ink jet, and lithographic.

5. The method of claim 1, wherein said forming step comprises forming a raised pattern using photolithography, and areas between said raised pattern form said recesses.

6. The method of claim 5, wherein said depositing step comprises depositing a black ink within said recesses to form a black border.

7. The method of claim 5, wherein said depositing step comprises depositing said ink using imaging pins having a smaller width and a smaller length than the width and length of said recesses.

8. The method of claim 5, wherein said depositing step comprises depositing said ink using a printing technique selected from the group consisting of typographic, ink jet, and lithographic.

9. The method of claim 1, wherein said forming step comprises mechanically forming a raised pattern onto said substrate, the areas between said raised pattern forming said recesses.

10. The method of claim 9, wherein said mechanically forming comprises depositing matrix ink into an intaglio imaging plate, hardening said matrix ink while retained within said intaglio plate, and transferring said matrix ink to said substrate.

11. The method of claim 10, wherein said depositing matrix ink step comprises depositing a black matrix ink within said intaglio plate, said hardening step comprises hardening said black matrix ink to form a black matrix pattern, and said depositing border ink step comprises depositing a black filler ink within said black matrix to form a black border.

12. The method of claim 10, wherein said transferring step comprises printing said raised pattern onto a glass substrate.

13. The method of claim 12, wherein prior to said transferring said raised pattern, an adhesive is applied to said glass substrate.

14. The method of claim 9, wherein said forming step comprises forming the raised pattern on a transfer layer.

15. The method of claim 14, wherein said substrate in said forming step comprises a transfer layer, said depositing filler ink step comprises depositing said filler ink while said raised pattern is on said transfer layer, to form a border/transfer layer composite;

and said method further comprises transferring said composite to a second substrate.

16. The method of claim 15, wherein said forming step comprises contacting said transfer layer with an embossing means to form a raised surface pattern and a recessed surface pattern on said transfer layer.

17. The method of claim 16, wherein said embossing means comprises a pattern roll or a pattern plate.

18. The method of claim 17, further comprising curing said transfer layer during said contacting step.

19. The method of claim 15, wherein said transferring step comprises transferring said composite so that said filler ink contacts the second substrate.

20. The method of claim 14, wherein said forming step comprises:

depositing a black matrix ink within a recessed pattern; and transferring said ink from said recessed pattern to said transfer layer to form a raised black matrix pattern on said transfer layer.

21. The method of claim 20, comprising at least partially hardening said ink prior to or during said transferring said ink step, so that said ink retains the shape of the recessed pattern after said transferring said ink step.

22. The method of claim 21, wherein said hardening step comprises curing said ink by exposure to ultraviolet radiation.

* * * * *